US007689145B2

(12) United States Patent
Nakamura et al.

(10) Patent No.: US 7,689,145 B2
(45) Date of Patent: Mar. 30, 2010

(54) REPLACEMENT UNIT, IMAGE FORMING APPARATUS, AND METHOD OF ATTACHING REPLACEMENT UNIT OF IMAGE FORMING APPARATUS

(75) Inventors: Takuma Nakamura, Kanagawa (JP); Takeshi Saitoh, Tokyo (JP); Yuko Arizumi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 106 days.

(21) Appl. No.: 12/132,864

(22) Filed: Jun. 4, 2008

(65) Prior Publication Data

US 2009/0022527 A1 Jan. 22, 2009

(30) Foreign Application Priority Data

Jul. 19, 2007 (JP) ..... 2007-188330

(51) Int. Cl.
*G03G 15/08* (2006.01)
*G03G 15/20* (2006.01)

(52) U.S. Cl. ..... 399/110; 399/262; 399/340; 430/124.21

(58) Field of Classification Search ..... 399/110, 399/113, 119, 120, 262, 340; 430/124.21, 430/124.22
See application file for complete search history.

(56) References Cited

U.S. PATENT DOCUMENTS

| | | | | |
|---|---|---|---|---|
| 3,158,509 | A | 11/1964 | Hudson | 118/61 |
| 4,607,939 | A | 8/1986 | Saito | 399/119 |
| 4,792,825 | A | 12/1988 | Saito et al. | 399/227 |
| 4,821,075 | A | 4/1989 | Saito et al. | 399/27 |
| 5,150,162 | A | 9/1992 | Saito | 399/224 |
| 5,455,662 | A | 10/1995 | Ichikawa et al. | 399/260 |
| 5,500,719 | A | 3/1996 | Ichikawa et al. | 399/238 |
| 5,502,552 | A | 3/1996 | Iwata et al. | 399/222 |
| 5,557,382 | A | 9/1996 | Tatsumi et al. | 399/262 |
| 5,627,631 | A | 5/1997 | Ichikawa et al. | 399/235 |
| 5,697,020 | A | 12/1997 | Sato et al. | 399/100 |
| 5,822,663 | A | 10/1998 | Ichikawa et al. | 399/262 |

(Continued)

FOREIGN PATENT DOCUMENTS

JP 40-10867 6/1965

(Continued)

OTHER PUBLICATIONS

U.S. Appl. No. 06/654,779, filed Sep. 26, 1984, Unknown.

*Primary Examiner*—Sophia S Chen
(74) *Attorney, Agent, or Firm*—Oblon, Spivak, McClelland, Maier & Neustadt, L.L.P.

(57) ABSTRACT

A replacement unit having a toner bottle and a fixing liquid bottle integrated with each other is attached to a printer main body (image forming apparatus main body). Toner particles accommodated in the toner bottle are allowed to be supplied to a development device of the image forming apparatus main body. A sheet member (sealing unit) of a liquid supplying port of the fixing liquid bottle is broken by an insertion pin provided in the printer main body in synchronization with the attachment of the replacement unit to the printer main body. A toner fixing liquid including a softening agent for softening the toner particles and a solvent for dissolving or dispersing the softening agent is supplied from the fixing liquid bottle to a fixing liquid storage of a fixing device of the printer main body.

18 Claims, 6 Drawing Sheets

U.S. PATENT DOCUMENTS

| | | | | |
|---|---|---|---|---|
| 5,918,090 | A | 6/1999 | Ichikawa et al. | 399/120 |
| 6,075,963 | A | 6/2000 | Ichikawa et al. | 399/262 |
| 6,141,521 | A | 10/2000 | Yuuki et al. | 399/270 |
| 6,289,195 | B1 | 9/2001 | Ichikawa et al. | 399/262 |
| 6,418,293 | B2 | 7/2002 | Ichikawa et al. | 399/262 |
| 6,560,414 | B2 | 5/2003 | Suda et al. | 399/12 |
| 6,751,431 | B2 | 6/2004 | Ichikawa et al. | 399/262 |
| 6,763,208 | B2 | 7/2004 | Nagatsuna et al. | 399/109 |
| 6,849,367 | B2 | 2/2005 | Shoshi et al. | 430/79 |
| 6,901,230 | B2 | 5/2005 | Ichikawa et al. | 399/262 |
| 6,978,103 | B2 | 12/2005 | Miura et al. | 399/116 |
| 6,996,354 | B2 | 2/2006 | Kimura et al. | 399/121 |
| 7,027,751 | B2 | 4/2006 | Miura et al. | 399/92 |
| 7,123,857 | B2 | 10/2006 | Harada et al. | 399/114 |
| 7,127,195 | B2 | 10/2006 | Kimura et al. | 399/116 |
| 7,175,958 | B2 | 2/2007 | Shoshi et al. | 430/79 |
| 7,203,446 | B2 | 4/2007 | Miura et al. | 399/116 |
| 7,298,991 | B2 | 11/2007 | Kimura et al. | 399/117 |
| 7,309,552 | B2 | 12/2007 | Arizumi et al. | 430/72 |
| 7,348,113 | B2 | 3/2008 | Shoshi et al. | 430/58.7 |
| 2004/0013442 | A1 | 1/2004 | Suzuki et al. | 399/92 |
| 2005/0254867 | A1* | 11/2005 | Kurotori et al. | 399/340 |
| 2006/0263712 | A1 | 11/2006 | Katano et al. | 430/124 |
| 2007/0147913 | A1 | 6/2007 | Katano et al. | 399/325 |
| 2007/0231027 | A1* | 10/2007 | Kamei et al. | 399/340 X |
| 2007/0243483 | A1 | 10/2007 | Katano et al. | 430/124.21 |
| 2007/0253757 | A1* | 11/2007 | Tanaka et al. | 399/340 |
| 2008/0063446 | A1 | 3/2008 | Katano et al. | 399/340 |
| 2008/0063448 | A1 | 3/2008 | Hozumi et al. | 399/350 |
| 2008/0069612 | A1 | 3/2008 | Nakamura et al. | 399/340 |

FOREIGN PATENT DOCUMENTS

| | | | |
|---|---|---|---|
| JP | 3290513 | B2 | 3/2002 |
| JP | 2004-109747 | | 4/2004 |
| JP | 2004-109751 | | 4/2004 |
| JP | 2006-308781 | | 11/2006 |

* cited by examiner

REPLACEMENT UNIT, IMAGE FORMING APPARATUS, AND METHOD OF ATTACHING REPLACEMENT UNIT OF IMAGE FORMING APPARATUS

BACKGROUND OF THE INVENTION

1. Field of the Invention

The present invention relates generally to image forming apparatuses such as copiers, printers, facsimile machines, and multifunction machines thereof. Among them, the present invention relates to an electrophotographic image forming apparatus. In the electrophotographic image forming apparatus, charging, writing, and development are performed to form a toner image on an image carrier. The toner image is directly transferred or indirectly transferred via an intermediate transfer member and then fixed by a fixing device. In this manner, the electrophotographic image forming apparatus records an image on a recording member such a paper. In particular, the present invention relates to the image forming apparatus including the fixing device that fixes toner particles on a recording member using a toner fixing liquid.

In addition, the present invention relates to a replacement unit that accommodates toner particles and a toner fixing liquid as consumable supplies and is replaceably provided in an image forming apparatus main body including such a fixing device. Furthermore, the present invention relates to a method of attaching the replacement unit to the image forming apparatus main body.

2. Description of the Related Art

Image forming apparatuses such as printers, facsimile machines, and copiers record images including, characters, symbols, etc., on recording members such as papers, clothes, and OHP films based on image information. Among various types of such image forming apparatuses, an electrophotographic image forming apparatus is widely used in offices because it can record high-definition images on plain paper at high speed.

The electrophotographic image forming apparatus has a charging device, a writing device, a development device, a transfer device, a cleaning device, a static elimination device, etc., around a drum-like or belt-like image carrier. In the electrophotographic image forming apparatus, the image carrier is charged as it is rotated and then subjected to writing so as to form an electrostatic latent image on its front surface. Subsequently, the electrostatic latent image is developed with the adhesion of toner particles to form a toner image on the image carrier. After this, the toner image is directly transferred or indirectly transferred via a belt-like intermediate transfer member or the like to a recording member. In this manner, an image is recorded on the recording member. The recording member having the toner image transferred thereon is introduced into a fixing device. In the fixing device, unfixed toner particles are fixed onto the recording member, while the front surface of the image carrier is cleaned by the cleaning device and static electricity is eliminated from the front surface so as to be ready for the next image formation.

In the electrophotographic image forming apparatus of this type, a fixing device of a heat fixing system is widely used because it provides a fast fixing speed and excellent fixed-image quality. According to the fixing device of the heat fixing system, toner particles on a recording member are heated and dissolved by a heat generator such as a halogen heater or a ceramic heater and pressured so as to be fixed on the recording member. However, the image forming apparatus including the fixing device of the heat fixing system consumes a large amount of electricity when heating the toner particles. Therefore, from the viewpoint of energy savings, the adoption of a low-power-consumption fixing device is strongly desired instead of the fixing device of the heat fixing system. Furthermore, the fixing device of the heat fixing system disadvantageously requires a long start-up time until image fixing starts.

In order to address the above problem, a fixing device of a vapor fixing system has been proposed as described, for example, in Patent Document 1. According to the fixing device of the vapor fixing system, a recording paper having unfixed toner particles remaining is inserted into a solvent vapor where the toner particles are dissolved. Therefore, the fixing device of the vapor fixing system consumes less energy than the heat fixing device of the heat fixing system does. However, due to an odor from a liquid and concerns about effects on the human body, the fixing device of the vapor fixing system is not widely used. Meanwhile, an odorless and harmless liquid allowing toner particles to become swollen and then be dissolved so as to be fixed has been developed. As a result, attention is given again to a fixing system using a liquid.

As described, for example, in Patent Document 2, a fixing device using an odorless and harmless toner fixing liquid discloses a method of fixing unfixed toner particles onto a recording member. Specifically, a toner fixing liquid including a softening agent for softening toner particles and a solvent for dispersing or dissolving the softening agent is used. The toner fixing liquid is attached to the recording member having a transferred image in a manner as to be sprayed or dropped, or coated with a roller, etc. Then, toner particles on the recording member are softened and the toner fixing liquid is dried. As a result, the unfixed toner particles are fixed onto the recording member.

Because the fixing device of this system does not require a toner heating process unlike the fixing device of the heat fixing system, it is suitable for achieving reduced power consumption and energy savings. For example, as shown in Patent Document 3, a toner fixing liquid is sprayed onto an intermediate transfer member and then directly transferred and fixed onto a recording member.

Patent Document 1: JP-A-40-10867
Patent Document 2: JP-B2-3290513
Patent Document 3: JP-A-2004-109747
Patent Document 4: JP-A-2006-308781

SUMMARY OF THE INVENTION

By the way, a toner fixing liquid is a consumable supply. Therefore, when the toner fixing liquid is used to fix toner particles, it is necessary to supply the toner fixing liquid into an image forming apparatus main body. As a general fixing method, the user is prompted to replenish toner particles as consumable supplies. This method is widely used. For example, as shown in Patent Document 4, the user replaces a bottle containing toner particles as a consumable supply with a new one in order to replenish the toner particles. As for the replacement of a toner fixing liquid, on the other hand, there is no commercially available product. Therefore, almost no related art techniques are disclosed.

In view of these circumstances, a first aspect of the present invention is to allow the user to efficiently and easily replenish a toner fixing liquid in an image forming apparatus where the toner fixing liquid is used and enhance the efficiency and simplicity of maintenance work.

A second aspect of the present invention is to facilitate the separate disposal of an integrated toner bottle and a fixing liquid bottle in consideration of environmental friendliness.

A third aspect of the present invention is to enhance the durability of a replacement unit having the toner bottle and the fixing liquid bottle integrated with each other.

A fourth aspect of the present invention is to simplify the connection and the separation of the toner bottle and the fixing liquid bottle so as to facilitate their assembly and separate disposal.

A fifth aspect of the present invention is to consume toner particles and the toner fixing liquid as consumable supplies almost at the same time so that the consumable supplies are consumed without waste, thus allowing the efficient and economical replacement of the replacement unit.

A sixth aspect of the present invention is to more efficiently replenish the toner fixing liquid in the replacement unit.

Meanwhile, if the toner fixing liquid leaking from the fixing liquid bottle of the replacement unit reaches the toner bottle of the replacement unit when the replacement unit having the toner bottle and the fixing liquid bottle integrated with each other is collectively provided in an image forming apparatus main body in a replaceable manner, unused toner particles may be dissolved. Accordingly, a seventh aspect of the present invention is to prevent the toner fixing liquid leaking from the fixing liquid bottle reaching the toner bottle.

An eighth aspect of the present invention is to provide the image forming apparatus that allows the user to efficiently and easily replenish the toner fixing liquid, thus enhancing the efficiency and simplicity of maintenance work.

A ninth aspect of the present invention is to consume the toner particles and the toner fixing liquid as consumable supplies almost at the same time in the image forming apparatus so that the consumable supplies are consumed without waste, thus allowing the efficient and economical replacement of the replacement unit.

A tenth aspect of the present invention is to save the user from having to frequently replace only a black replacement unit.

An eleventh aspect of the present invention is to more efficiently replenish the toner fixing liquid in the image forming apparatus.

A twelfth aspect of the present invention is to provide a method of attaching the replacement unit of the image forming apparatus that allows the user to efficiently and easily replenish the toner fixing liquid, thus enhancing the efficiency and simplicity of maintenance work.

A thirteenth aspect of the present invention is to more efficiently replenish the toner fixing liquid in the method of attaching the replacement unit of the image forming apparatus.

A fourteenth aspect of the present invention is to facilitate the replacement of the replacement unit even when it is in use.

In order to achieve the first aspect, an embodiment of the present invention provides a replacement unit. The replacement unit includes a toner bottle and a fixing liquid bottle. The toner bottle and the fixing liquid bottle are integrated with each other and collectively provided in an image forming apparatus main body in a replaceable manner. The toner bottle accommodates toner particles to be supplied to a development device of the image forming apparatus main body. The fixing liquid bottle accommodates a toner fixing liquid that includes a softening agent for softening the toner particles and a solvent for dissolving or dispersing the softening agent. The toner fixing liquid is supplied to a fixing device of the image forming apparatus main body so as to be applied to unfixed toner particles on a recording member. The toner fixing liquid dissolves the unfixed toner particles and is fixed on the recording member.

Here, the development device visualizes an electrostatic latent image formed on an image carrier with the attachment of the toner particles in the image forming apparatus main body. The replacement unit of the embodiment has the toner bottle and the fixing liquid bottle integrated with each other and is collectively provided in the image forming apparatus main body in a replaceable manner. When the toner bottle is replaced, the fixing liquid bottle is also replaced. The above expression "the toner bottle and the fixing liquid bottle integrated with each other" refers not only to a case where they are totally integrated with each other by using the same member, but also to a case where they are connected together in the image forming apparatus main body in a replaceable manner.

According to this configuration, when the toner bottle is replaced, the fixing liquid bottle is also replaced. Therefore, the replenishment of the toner particles and the toner fixing liquid into the image forming apparatus main body are performed at the same time. As a result, it is possible for the user to efficiently and easily replenish the toner particles and the toner fixing liquid without being aware of the fact that the toner fixing liquid as a consumable supply is a liquid, thus enhancing the efficiency and the simplification of maintenance work.

In order to achieve the second aspect, in the replacement unit described above, the toner bottle and the fixing liquid bottle may be separately formed. They may not be totally integrated with each other by using the same member, but integrally connected together in a detachable manner. The integrated toner bottle and the fixing liquid bottle are capable of being separated at the time of disposal.

According to this configuration, the toner bottle and the fixing liquid bottle generally made of different materials are separated at the time of disposal. Therefore, it is possible to facilitate the separate disposal of the toner bottle and the fixing liquid bottle in consideration of environmental friendliness.

In order to achieve the third aspect, in the replacement unit described above, the toner bottle and the fixing liquid bottle may have different materials. For example, the toner bottle may be made of a polyester material and the fixing liquid bottle may be made of polycarbonate, etc. The toner particles are accommodated in the toner bottle made of the material that is not easily soiled by the toner particles, and the toner fixing liquid is accommodated in the fixing liquid bottle made of the material that is not easily soiled by the toner fixing liquid. Then, the toner bottle and the fixing liquid bottle are integrated with each other.

According to this configuration, the toner bottle is made of the material that is not easily soiled by the toner particles, and the fixing liquid bottle is made of the material that is not easily soiled by the toner fixing liquid. Therefore, it is possible to enhance the durability of the replacement unit having the toner bottle and the toner fixing bottle integrated with each other.

In order to achieve the fourth aspect, in the replacement unit described above, the toner bottle and the fixing liquid bottle may be connected together by a snap fit connection. The toner bottle and the fixing liquid bottle are capable of being freely connected and separated by a snap fit connection.

According to this configuration, the toner bottle and the fixing liquid bottle are connected together by a snap fit connection. Therefore, it is possible to manually perform the connection and the separation of the toner bottle and the fixing liquid bottle without using any tools, facilitating the assembly and the separate disposal of the replacement unit.

In order to achieve the fifth aspect, in the replacement unit described above, assuming that an amount of the toner fixing liquid necessary for fixing the toner particles accommodated in the toner bottle is A, an amount of the toner fixing liquid 1.0 through 1.2 times the amount A may be accommodated in the fixing liquid bottle. Accordingly, even if some of the toner fixing liquid is evaporated due to its long time use, the shortage of the toner fixing liquid is prevented. The toner particles in the toner bottle and the toner fixing liquid in the fixing liquid bottle are consumed almost at the same time.

According to this configuration, the toner particles in the toner bottle and the toner fixing liquid in the fixing liquid bottle are consumed almost at the same time when the replacement unit is replaced. Therefore, a shortage and an unnecessary excess of the toner fixing liquid are prevented, making it possible to consume the consumable supply without waste and efficiently and economically replace the replacement unit. Furthermore, the extra amount of the toner fixing liquid is accommodated in the fixing liquid bottle. Therefore, even if some of the toner fixing liquid is evaporated due to its long time use, a shortage of the toner fixing liquid is prevented.

In order to achieve the sixth aspect, in the replacement unit described above, a liquid supplying port of the fixing liquid bottle may be sealed by a breakable sealing unit. When the replacement unit is attached to the image forming apparatus main body, the sealing unit is broken to supply the toner fixing liquid from the liquid supplying port of the fixing liquid bottle to the fixing device of the image forming apparatus main body.

According to this configuration, when the replacement unit is attached to the image forming apparatus main body, the sealing unit is broken to supply the toner fixing liquid from the liquid supplying port of the fixing liquid bottle to the fixing device. Therefore, it is possible to more efficiently replenish the toner fixing liquid.

In order to achieve the seventh aspect, in the replacement unit described above, a toner supplying direction from a toner supplying port of the toner bottle may be different from a fixing liquid supplying direction from a liquid supplying port of the fixing liquid bottle. Accordingly, the toner fixing liquid leaking from the liquid supplying port of the fixing liquid bottle is prevented reaching the toner supplying port of the toner bottle.

According to this configuration, when the replacement unit having the toner bottle and the fixing liquid bottle integrated with each other is collectively provided in the image forming apparatus main body in a replaceable manner, the toner fixing liquid leaking from the liquid supplying port of the fixing liquid bottle is prevented reaching the toner supplying port of the toner bottle having the different supplying direction. As a result, it is possible to prevent unused toner particles around the toner supplying port being dissolved.

In order to achieve the seventh aspect, in the replacement unit described above, a gap may be provided between a toner supplying port of the toner bottle and a liquid supplying port of the fixing liquid bottle such that the liquid supplying port is positioned lower than the toner supplying port in a gravity direction when the replacement unit is attached to the printer main body. Accordingly, the toner fixing liquid leaking from the liquid supplying port of the fixing liquid bottle is prevented reaching the toner supplying port of the toner bottle due to gravity.

According to this configuration, when the replacement unit having the toner bottle and the fixing liquid bottle integrated with each other is collectively provided in the image forming apparatus main body in a replaceable manner, the toner fixing liquid leaking from the liquid supplying port of the fixing liquid bottle is prevented reaching the toner supplying port of the toner bottle due to gravity. As a result, it is possible to prevent unused toner particles around the toner supplying port being dissolved.

In order to achieve the seventh aspect, in the replacement unit described above, a toner supplying port of the toner bottle and a liquid supplying port of the fixing liquid bottle may be partitioned by a partition wall. Accordingly, the toner fixing liquid leaking from the liquid supplying port of the fixing liquid bottle is prevented flowing out the partition wall and reaching the toner supplying port of the toner bottle.

According to this configuration, when the replacement unit having the toner bottle and the fixing liquid bottle integrated with each other is collectively provided in the image forming apparatus main body in a replaceable manner, the toner fixing liquid leaking from the liquid supplying port of the fixing liquid bottle is prevented reaching the toner supplying port of the toner bottle due to the partition wall. As a result, it is possible to prevent unused toner particles around the toner supplying port being dissolved.

In order to achieve the seventh aspect, in the replacement unit described above, a liquid supplying port of the fixing liquid bottle may be surrounded by a partition wall. Accordingly, the toner fixing liquid leaking from the liquid supplying port of the fixing liquid bottle is prevented flowing out the surrounding partition wall and reaching the toner supplying port of the toner bottle.

According to this configuration, when the replacement unit having the toner bottle and the fixing liquid bottle integrated with each other is collectively provided in the image forming apparatus main body in a replaceable manner, the toner fixing liquid leaking from the liquid supplying port of the fixing liquid bottle is prevented flowing out the surrounding partition wall and reaching the toner supplying port of the toner bottle. As a result, it is possible to prevent unused toner particles around the toner supplying port being dissolved.

In order to achieve the eighth aspect, an embodiment of the present invention provides an image forming apparatus such as a copier, a printer, a facsimile machine, or a multifunction machine thereof including the replacement unit described above. The replacement unit has the toner bottle and the fixing liquid bottle integrated with each other and is collectively provided in the image forming apparatus main body in a replaceable manner. When the toner bottle is replaced, the fixing liquid bottle is also replaced.

According to this configuration, when the toner bottle is replaced, the fixing liquid bottle is also replaced. Therefore, the replenishment of the toner particles and the toner fixing liquid into the image forming apparatus main body are performed at the same time. As a result, it is possible for the user to efficiently and easily replenish the toner particles and the toner fixing liquid without being aware of the fact that the toner fixing liquid as a consumable supply is a liquid, thus enhancing the efficiency and the simplification of maintenance work and providing an image forming apparatus excellent in energy savings.

In order to achieve the ninth aspect, in the image forming apparatus described above, if there are plural of the replacement units having different amounts of the toner particles accommodated in the toner bottles, only the fixing liquid bottle accommodating an amount of the toner fixing liquid 1.0 through 1.2 times an amount A of the toner fixing liquid necessary for fixing the toner particles accommodated in the toner bottle of one replacement unit is capable of being connected to the corresponding toner bottle of the replacement unit.

Accordingly, only the fixing liquid bottle accommodating the toner fixing liquid 1.0 through 1.2 times as large as the amount A necessary for fixing the toner particles accommodated in the toner bottle is capable of being connected to the toner bottle. If the amount of the toner fixing liquid does not balance with that of the toner particles, the fixing liquid bottle is not capable of being connected to the toner bottle.

According to this configuration, if the fixing liquid bottle accommodates the toner fixing liquid that does not balance with the toner particles accommodated in the toner bottle, the fixing liquid bottle is not capable of being connected to the toner bottle. Thus, the toner particles in the toner bottle and the toner fixing liquid in the fixing liquid bottle are consumed almost at the same time. Therefore, a shortage and an unnecessary excess of the toner fixing liquid are prevented, making it possible to consume the consumable supply without waste and efficiently and economically replace the replacement unit. Furthermore, the extra amount of the toner fixing liquid is accommodated in the fixing liquid bottle. Therefore, even if some of the toner fixing liquid is evaporated due to its long time use, a shortage of the toner fixing liquid is prevented.

In order to achieve the tenth aspect, in the image forming apparatus described above, plural colors of the replacement units accommodating different colors of the toner particles such as black, magenta, yellow, and cyan may be provided in the image forming apparatus main body in a replaceable manner. The accommodation amounts of the toner particles and the toner fixing liquid of the black replacement unit may be made larger than that of the toner particles and the toner fixing liquid, respectively, of other colors of the replacement units among the plural colors of the replacement units. Generally, the black replacement unit more frequently used than other colors of the replacement units is made larger in size than other colors of the replacement units.

In offices, it is a general practice to prepare documents only in black. Therefore, black toner particles are consumed faster than other colors of toner particles. In consideration of this, the accommodation amount of the toner particles and the toner fixing liquid of the black replacement unit is made larger than those of the toner particles and the toner fixing liquid of the other colors of the replacement units. As a result, it is possible to save the user from having to frequently replace only the black replacement unit.

In order to achieve the eleventh aspect, in the image forming apparatus described above, a member that breaks a sealing unit of the replacement unit in synchronization with the attachment of the replacement unit to the image forming apparatus main body may be provided in the image forming apparatus main body. Accordingly, in synchronization with the attachment of the replacement unit to the image forming apparatus main body, the member provided in the image forming apparatus main body breaks the sealing unit to supply the toner fixing liquid from the liquid supplying port of the fixing liquid bottle to the fixing device of the image forming apparatus main body.

According to this configuration, in synchronization with the attachment of the replacement unit to the image forming apparatus main body, the member provided in the image forming apparatus main body breaks the sealing unit to supply the toner fixing liquid from the liquid supplying port of the fixing liquid bottle to the fixing device. Therefore, it is possible to more efficiently replenish the toner fixing liquid in synchronization with the attachment of the replacement unit.

In order to achieve the eleventh aspect, in the image forming apparatus described above, a sheet member such as a thin paper and a tape that seals a liquid supplying port of the fixing liquid bottle may be used as the sealing unit. A member such as a pin that penetrates the sheet member in synchronization with the attachment of the replacement unit to the image forming apparatus main body may be provided in the image forming apparatus main body.

Accordingly, in synchronization with the attachment of the replacement unit to the image forming apparatus main body, the member provided in the image forming apparatus main body penetrates the sheet member to supply the toner fixing liquid from the liquid supplying port of the fixing liquid bottle to the fixing device of the image forming apparatus main body.

According to this configuration, in synchronization with the attachment of the replacement unit to the image forming apparatus main body, the member provided in the image forming apparatus main body penetrates the sheet member to supply the toner fixing liquid from the liquid supplying port of the fixing liquid bottle to the fixing device. Therefore, it is possible for the user to more efficiently replenish the toner fixing liquid without causing the toner fixing liquid to contact the hands.

In order to achieve the twelfth aspect, an embodiment of the present invention provides a method of attaching a replacement unit of an image forming apparatus. The method includes attaching a replacement unit having a toner bottle and a fixing liquid bottle integrated with each other to an image forming apparatus main body; allowing toner particles accommodated in the toner bottle to be supplied to a development device of the image forming apparatus main body; breaking a sealing unit of a liquid supplying port of the fixing liquid bottle using a member provided in the image forming apparatus main body in synchronization with the attachment of the replacement unit to the image forming apparatus main body; and supplying a toner fixing liquid including a softening agent for softening the toner particles and a solvent for dissolving or dispersing the softening agent from the fixing liquid bottle to a fixing liquid storage of a fixing device of the image forming apparatus main body.

The replacement unit has the toner bottle and the fixing liquid bottle integrated with each other and is collectively provided in the image forming apparatus main body in a replaceable manner. When the toner bottle is replaced, the fixing liquid bottle is also replaced.

According to this configuration, when the toner bottle is replaced, the fixing liquid bottle is also replaced. Therefore, the replenishment of the toner particles and the toner fixing liquid into the image forming apparatus main body are performed at the same time. As a result, it is possible for the user to efficiently and easily replenish the toner particles and the toner fixing liquid without being aware of the fact that the toner fixing liquid as a consumable supply is a liquid, thus enhancing the efficiency and the simplification of maintenance work.

In order to achieve the thirteenth aspect, in the method described above, a sheet member such as a thin paper and a tape that seals the liquid supplying port of the fixing liquid bottle may be used as the sealing unit. The sheet member may be penetrated by a member such as a pin provided in the image forming apparatus main body in synchronization with the attachment of the replacement unit to the image forming apparatus main body so as to supply the toner fixing liquid to the fixing liquid storage.

Accordingly, in synchronization with the attachment of the replacement unit to the image forming apparatus main body, the member provided in the image forming apparatus main body penetrates the sheet member sealing the liquid supplying port of the fixing liquid bottle to supply the toner fixing liquid from the liquid supplying port of the fixing liquid bottle to the fixing liquid storage of the fixing device of the image forming apparatus main body.

According to this configuration, in synchronization with the attachment of the replacement unit to the image forming apparatus main body, the member provided in the image forming apparatus main body penetrates the sheet member sealing the liquid supplying port of the fixing liquid bottle to supply the toner fixing liquid from the liquid supplying port of the fixing liquid bottle to the fixing liquid storage. Therefore, it is possible for the user to more efficiently replenish the toner fixing liquid without causing the toner fixing liquid to contact the hands.

In order to achieve the fourteenth aspect, in the method described above, the toner fixing liquid may be supplied to the fixing liquid storage at a time when the replacement unit is attached to the image forming apparatus main body. When the replacement unit is attached to the image forming apparatus main body, the toner fixing liquid accommodated in the fixing liquid bottle of the replacement unit is supplied to the fixing liquid storage of the fixing device at a time. Accordingly, the fixing liquid bottle is made empty.

According to this configuration, when the replacement unit is attached to the image forming apparatus main body, the toner fixing liquid is supplied to the fixing liquid storage at a time so that the fixing liquid bottle becomes empty. Therefore, when it is necessary to replace the fixing liquid bottle for some reason even when it is in use, it is possible for the user to perform the operation without causing the toner fixing liquid to contact the hands and clothes and soiling a floor and the printer main body.

Other objects, features and advantages of the present invention will become more apparent from the following detailed description when read in conjunction with the accompanying drawings.

DETAILED DESCRIPTION OF THE PREFERRED EMBODIMENTS

Referring to the accompanying drawings, a description is made of the best mode for carrying out the present invention.

Figure 1:
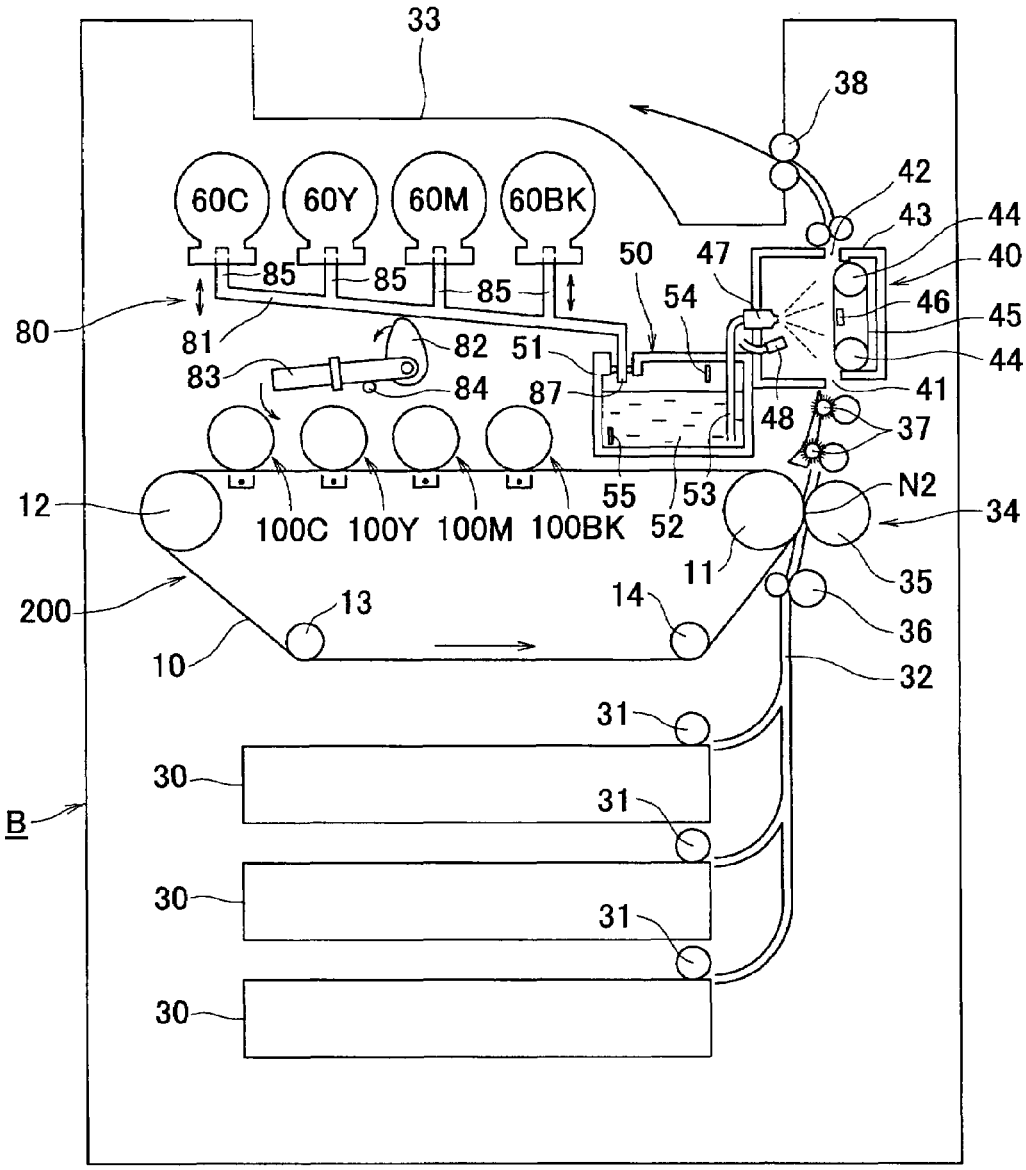
FIG. 1 shows an entire schematic configuration of the internal mechanism of a color printer in which image carriers are arranged in tandem as an example of an image forming apparatus.

FIG. 1 shows an entire schematic configuration of the internal mechanism of a color printer in which image carriers are arranged in tandem as an example of an image forming apparatus.

Inside a printer main body B as an image forming apparatus main body, four image forming devices 100 for the colors of black (BK), magenta (M), yellow (Y), and cyan (C), respectively, are provided. In addition, an intermediate transfer device 200 is provided in which an endless intermediate transfer belt 10 is wrapped around four rollers 11 through 14. The four image forming devices 100BK, 100M, 100Y, and 100C are different only in the colors of toner particles, but are the same in configuration, and they are arranged in tandem on the intermediate transfer device 200 along the intermediate transfer belt 10.

Figure 2:
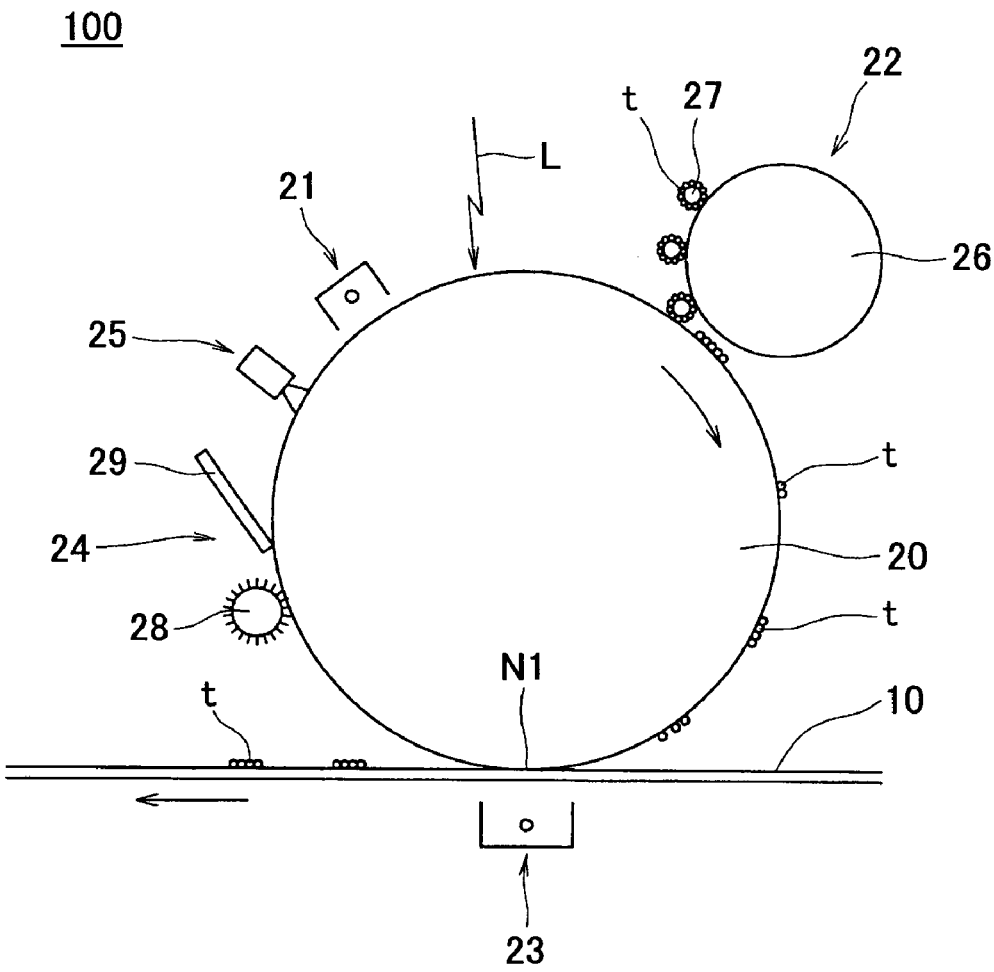
FIG. 2 shows a schematic configuration of one image forming device of the color printer.

FIG. 2 shows a schematic configuration of one image forming device 100.

Each image forming device 100 includes a drum-like image carrier 20. Around the image carrier 20 are arranged a charging device 21 composed of an electrifying charger, etc., a not-shown exposure device, a development device 22, a primary transfer device 23 that is composed of a transfer charger, etc., and provided via the intermediate transfer belt 10, a cleaning device 24, and a static elimination device 25 composed of a static elimination lamp, etc.

As the image carrier 20 is rotated clockwise, the front surface of the image carrier 20 is uniformly charged by the charging device 21. Next, writing light L is applied to the front surface by the not-shown exposure device based on an image signal to form an electrostatic latent image on the image carrier 20. Then, negatively charged toner particles t on a positively charged carrier 27 held at a development sleeve 26 of the development device 22 are transferred onto the image carrier 20. The transferred toner particles t undergo primary transfer onto the intermediate transfer belt 10 at a primary transfer position N1 by the primary transfer device 23.

At this time, toner particles t left on the image carrier 20 are scraped and removed by a cleaning brush 28 and a cleaning blade 29 of the cleaning device 24. After this, the electric charges on the front surface of the image carrier 20 are eliminated by the static elimination device 25 so as to be ready for the next image formation.

As shown in FIG. 1, paper feeding trays 30 are provided in multistages (three stages in FIG. 1) below the intermediate transfer device 200. Each of the paper feeding trays 30 is provided with a corresponding paper feeding roller 31 for feeding recording members accommodated in the paper feeding tray 30 and a conveying path 32 for conveying the recording members fed by the paper feeding roller 31. The conveying paths 32 of the paper feeding trays 30 are joined together and extend up to a paper discharging stack part 33 provided at the top surface of the printer main body B.

Along the conveying path 32, a transfer roller 35 of a secondary transfer device 34 is arranged opposing the intermediate transfer device 200 and a secondary transfer position N2 is formed at the transfer roller 35. On the upstream side of the secondary transfer position, a pair of resist rollers 36 are provided. On the downstream side of the secondary transfer position N2, two spurs are successively provided. A fixing device 40 is arranged on the downstream side of the spurs 37, and a pair of paper discharging rollers 38 are provided on the downstream side of the fixing device 40.

As the intermediate transfer belt 10 is rotated counterclockwise, toner images in black, magenta, yellow, and cyan formed on the image carriers 20 of the respective image forming devices are sequentially transferred onto the intermediate transfer belt 10 and superposed at the primary transfer position N1 as described above. Accordingly, a color image is formed on the intermediate transfer belt 10. On the other hand, the recording member fed by the paper feeding roller 31 is fed into the secondary transfer position N2 while adjusting timing with the pair of resist rollers 36 via the conveying path 32.

Subsequently, the color image on the intermediate transfer belt 10 undergoes secondary transfer onto the recording member fed into the secondary transfer position N2 by the transfer roller 35. Then, the recording medium is conveyed to the fixing device 40 by the spurs 37 in a manner so as not to displace the toner particles. After the toner images are fixed on the recording member by the fixing device 40, the recording member is discharged onto the paper discharging stack part 33 by the pair of paper discharging rollers 38.

The fixing device 40 has a fixing case 43 in which are formed an inlet port 41 for receiving the recording member conveyed via the conveying path 32 and an outlet port 42 for feeding the recording member on which images have been fixed. In the fixing case 43, a conveying belt 45 is wrapped around rollers 44 along a path extending from the inlet port 41 to the outlet port 42, and an electrode 46 is arranged inside the conveying belt 45. Furthermore, in the fixing case 43, a fixing liquid sprayer 47 is held toward the belt surface of the conveying belt 45 and an ionizer 48 is provided below the fixing liquid sprayer 47.

At a position adjacent to the fixing device 40, a fixing liquid storage 50 is provided. The fixing liquid storage 50 has a tank case 51 in which a toner fixing liquid 52 is stored and a suction pipe 53 provided in a manner as to hang from the fixing liquid sprayer 47 is drawn. In addition, water-level sensors 54 and 55 that detect the full status and the empty status of the toner fixing liquid 52, respectively, are provided in the tank case 51.

When the recording member having transferred images is conveyed to the fixing device 40, inserted into the fixing case 43 from the inlet port 41, and then reaches the position of the conveying belt 45, the recording member is charged to the positive polarity by the electrode 46 and suctioned onto the conveying belt 45. Then, the toner fixing liquid 52 in the tank case 51 pumped up via the suction pipe 53 is sprayed onto the recording member in mist form by the fixing liquid sprayer 47. At this time, the sprayed toner fixing liquid 52 is charged, for example, to the positive polarity by the ionizer 48 and attracted onto the negatively-charged recording member by a coulomb force. In this manner, the toner fixing liquid 52 is uniformly attached to the recording member.

Accordingly, with the application of the toner fixing liquid 52 onto the recording member, unfixed toner particles on the recording member are either dissolved or swollen so as to be softened. Then, they are dried and fixed on the recording member. Of course, the recording member may be subjected to a process of sandwiching the recording member with rollers, etc., immediately after the fixing of the unfixed toner particles so that a fixing force applied to the recording member is enhanced and the smoothness of the front surface of toner particles is improved to increase a gloss level.

In FIG. 1, the four replacement units 60BK, 60M, 60Y, and 60C for the colors of black (BK), magenta (M), yellow (Y), and cyan (C), respectively, are arranged in tandem below the paper discharging stack part 33 of the printer main body B. These four replacement units 60 are different only in the colors of accommodated toner particles, but are the same in configuration.

Figure 3:
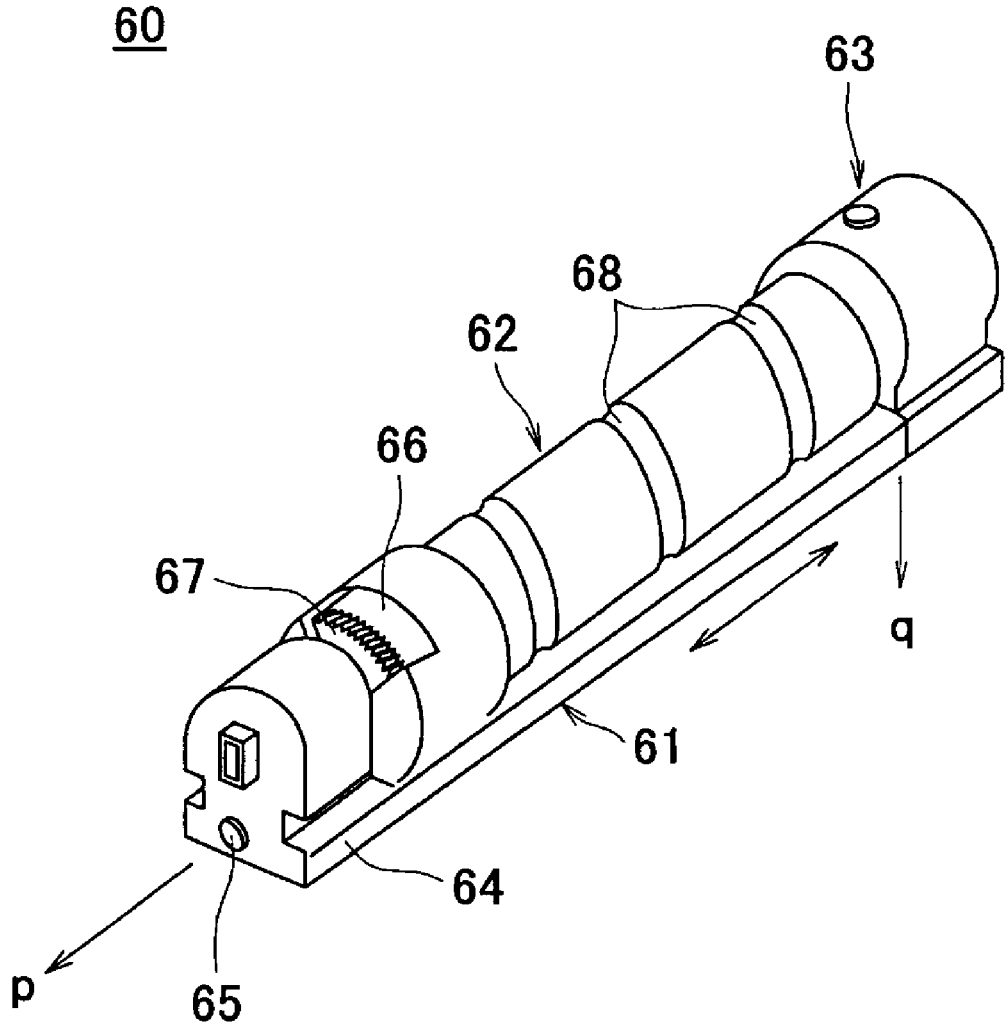
FIG. 3 is a perspective view of one replacement unit of the color printer shown in FIG.

FIG. 3 shows an external appearance of one replacement unit 60.

As shown in FIG. 3, the replacement unit 60 has a toner bottle 62 and a fixing liquid bottle 63 integrated with each other via the attachment to a toner bottle attachment board 61. The replacement unit 60 is put in and taken out from the printer main body B in its longitudinal direction as indicated by an arrow in FIG. 3, for example, when the front cover of the printer main body B is opened. That is, the replacement unit 60 is collectively provided in the printer main body B in a replaceable manner.

For the insertion of the replacement unit 60 into the printer main body B, the toner bottle attachment board 61 has bilateral rail-like projecting parts 64 that are engaged with grooves in the printer main body B so as to be guided, a shutter 65 that is biased to seal a toner supplying port at all times, a gear 67 a part of which is exposed from an opening 66, etc. Furthermore, the toner bottle 62 has spiral grooves 68 on its peripheral surface forming inward projections toward an inner peripheral surface. The toner bottle 62 is attached to the toner bottle attachment board 61 so as to rotate about a longitudinal axis when the gear 67 is rotated.

Figure 4:
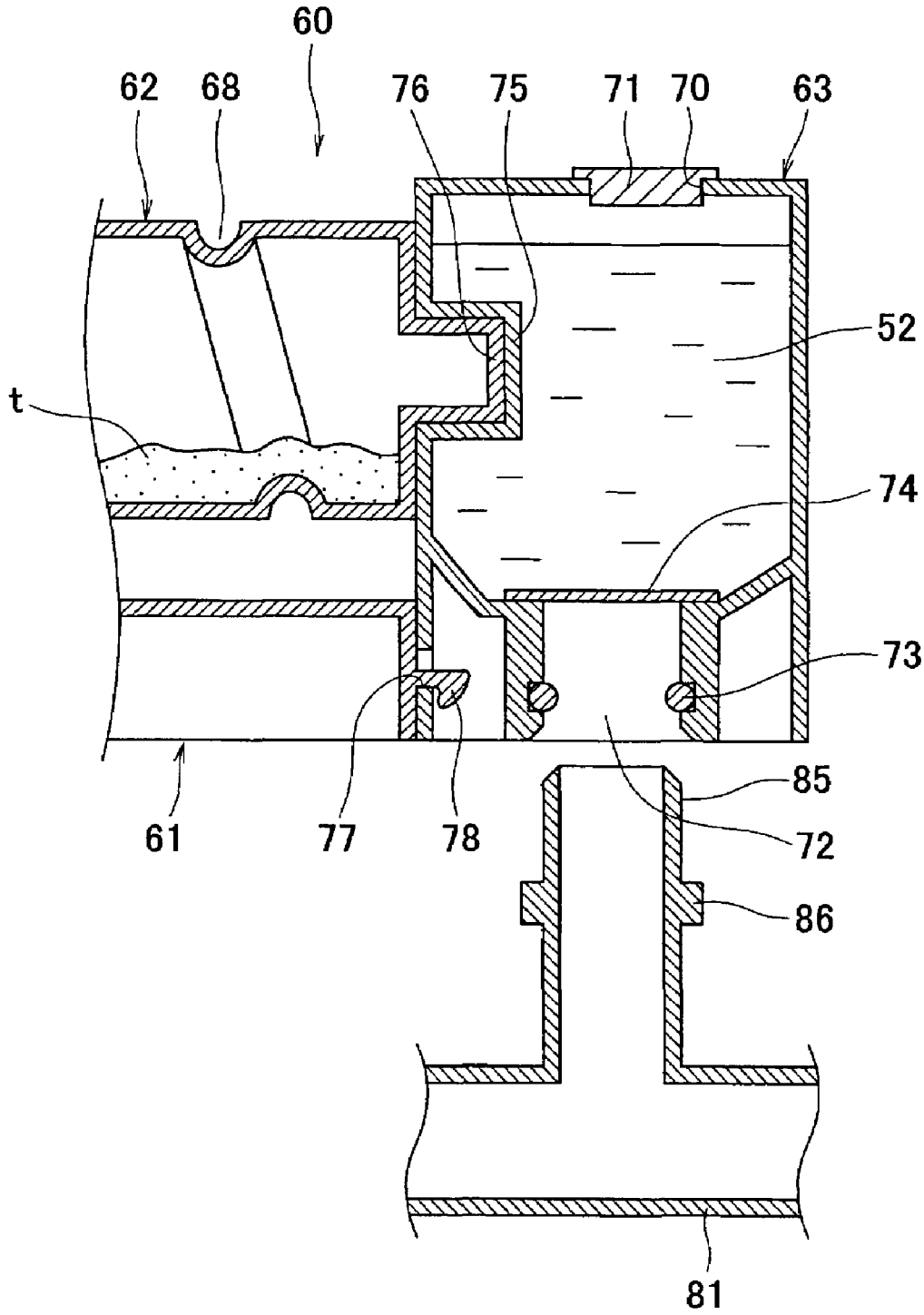
FIG. 4 is a side cross-sectional view showing an end part of the replacement unit including a fixing liquid bottle 63.
Figure 5:
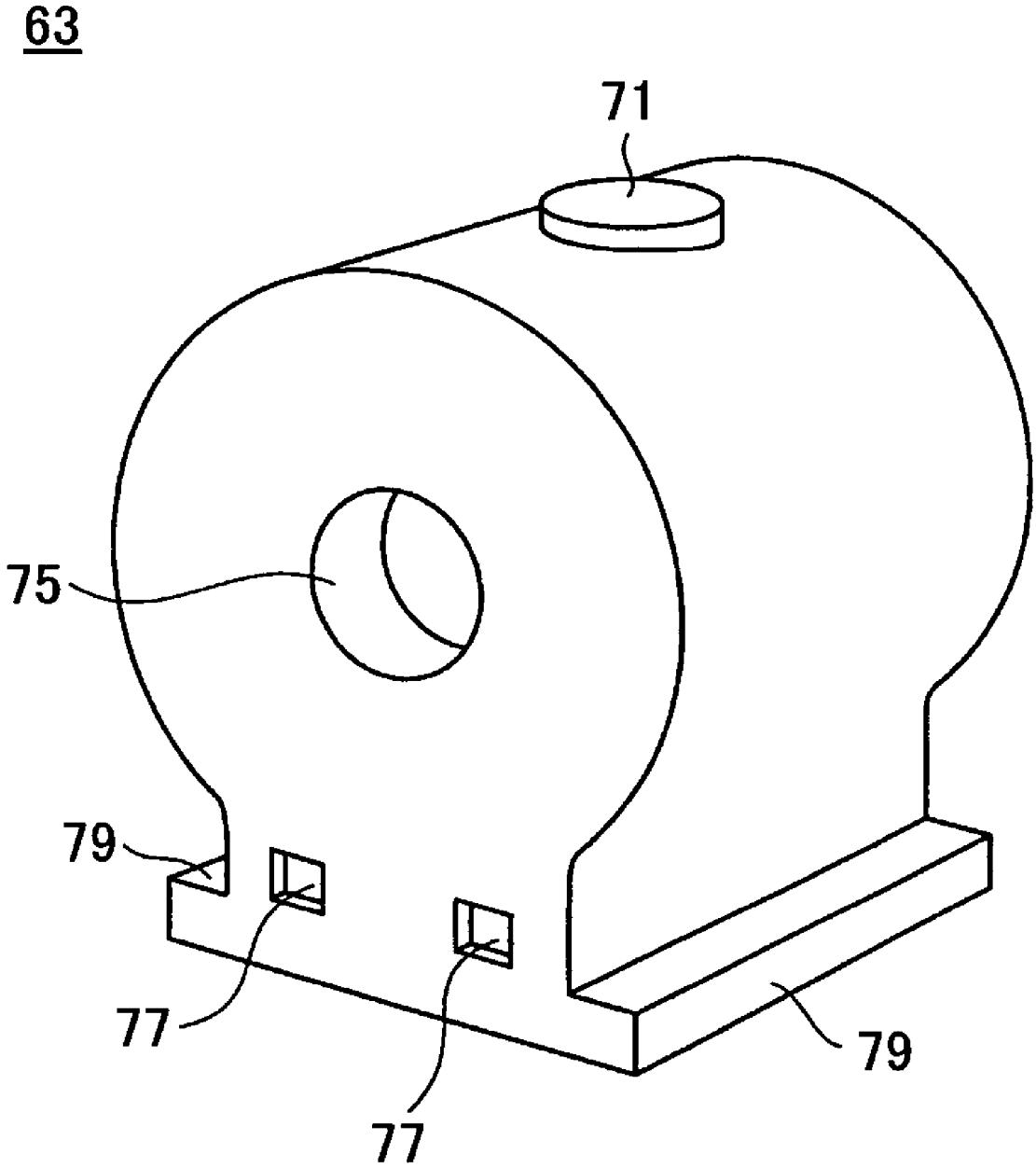
FIG. 5 is an external perspective view of the fixing liquid bottle.

FIG. 4 is a side cross-sectional view showing an end part of the replacement unit 60 including the fixing liquid bottle 63. FIG. 5 shows an external appearance of the fixing liquid bottle 63.

The fixing liquid bottle 63 has a liquid replenishing port 70 on its top surface. The toner fixing liquid 52 is replenished into the fixing liquid bottle 63 through the liquid replenishing port 70 in a manufacturing process, and the liquid replenishing port 70 is sealed by a lid 71. After the replenishment of the toner fixing liquid 52, the liquid replenishing port 70 may be sealed by welding, etc., so as to prevent the leakage of the liquid. Furthermore, the fixing liquid bottle 63 has a liquid supplying port 72 that projects from a lower part of the fixing liquid bottle 63 and has an opening facing downward, and an O-ring 73 is provided at the inner peripheral surface of the liquid supplying port 72. At the bottom part of the fixing liquid bottle 63, a sheet member 74 such as a thin paper or a tape is provided as a breakable sealing unit so as to seal the liquid supplying port 72.

In addition, a fitting concave part 75 is formed at the side surface of the fixing liquid bottle 63. A fitting convex part 76 as the tip end of the toner bottle 62 fits in the fitting concave part 75, whereby the toner bottle 62 is rotatably held about the convex part 76. Moreover, two locking holes 77 having an interval between them are formed side by side in the fixing liquid bottle 63. Two locking claws 78 provided in the base of the toner bottle attachment board 61 are hooked on corresponding the locking holes 77 so that the toner bottle attachment board 61 is detachably connected to the fixing liquid bottle 63 by a snap fit connection. Accordingly, the toner bottle attachment board 61, the toner bottle 62, and the fixing liquid bottle 63 are integrated with each other. Reference numeral 79 denotes a rail-like projection. When the toner bottle attachment board 61 and the fixing liquid bottle 63 are connected together, the rail-like projections 79 and the rail-like projecting parts 64 are made continuous with each other.

The respective toner bottles 62 accommodate the toner particles t in black (BK), magenta (M), yellow (Y), and cyan (C) to be supplied to the development device 22 of the printer main body B. The fixing liquid bottle 63 accommodates the toner fixing liquid 52 that includes a softening agent for softening the toner particles t and a solvent for dissolving or dispersing the softening agent and is supplied to the fixing device 40 of the printer main body B.

Here, sufficient toner fixing liquid 52 is put in the fixing liquid bottle 63 to fix all the toner particles t in the toner bottle 62. Because the replacement of the replacement unit 60 is not desired if even a small amount of toner particles t are left in the toner bottle 62, it is preferable that the toner particles t be consumed faster than the toner fixing liquid 52. Therefore, in this example, any shortage of the toner fixing liquid 52 caused by evaporation with time and recovery loss can be covered. That is, assuming that an amount of the toner fixing liquid 52 necessary for fixing the toner particles t accommodated in the toner bottle 62 is A, an amount of the toner fixing liquid 52 "1.0" through "1.2" times the amount A is accommodated in the fixing liquid bottle 63.

As described above, the toner bottle 62 and the fixing liquid bottle 63 are separately formed and integrally connected together in a detachable manner. For example, the toner bottle 62 is made of a polyester material such as PC-PET, having low likelihood of being soiled by the toner particles t. The fixing liquid bottle 63 is made of polycarbonate that is different from the toner bottle 62 in material, having low likelihood of being soiled by the toner fixing liquid 52.

When the replacement unit 60 is attached to the printer main body B, the shutter 65 is moved against a biasing force to open the toner supplying port of the toner bottle attachment board 61 and the gear 67 is meshed with the driving gear of the printer main body B. Then, the gear 67 is rotated by the driving force of the printer main body B. With the rotation of the gear 67, the toner bottle 62 is also rotated. Accordingly, the toner particles t accommodated in the toner bottle 62 are fed to the toner supplying port guided by the projections formed by the spiral grooves 68. Then, the toner particles t are fed from the toner supplying port to the printer main body B and supplied to the development device 22 of the printer main body B.

As shown in FIG. 1, a fixing liquid supplying device 80 is provided between the four replacement units 60BK, 60M, 60Y, and 60C and the four image forming devices 100BK, 100M, 100Y, and 100C. The fixing liquid supplying device 80 is provided with an introduction pipe 81, a cam 82 that moves the introduction pipe 81 up and down, a handle 83 that turns the cam 82, a stopper pin 84 that regulates the movements of the handle 83, etc.

The introduction pipe 81 has insertion pins 85 that project upward and are inserted into or withdrawn from the liquid supplying ports 72 of the fixing liquid bottles 63 of the respective replacement units 60 according to the up-and-down movements of the introduction pipe 81, collar parts 86 (see FIG. 4) that are butted against the opening edges of the liquid supplying ports 72 to regulate an insertion amount of the insertion pins 85, a tip end port 87 that leads into the tank case 51 of the fixing liquid storage 50, etc.

When it is detected that the toner particles t in black (BK), magenta (M), yellow (Y), and cyan (C) are consumed, or when it is detected by the water-level sensor 55 that the toner fixing liquid 52 becomes empty, the front cover of the printer main body B is opened so that the handle 83 is turned about a spindle counterclockwise in FIG. 1 and the cam 82 on the same spindle is also turned about the spindle counterclockwise. Then, the introduction pipe 81 is moved downward due to gravity as it is guided by a not-shown guide member and the insertion pins 85 are withdrawn from the liquid supplying ports 72. Accordingly, it is possible to pull out the replacement unit 60 from the printer main body B. After the replacement unit 60 is pulled out in its longitudinal direction, a new replacement unit 60 having the toner bottle 62 and the fixing liquid bottle 63 integrated with each other is attached to the printer main body B.

Accordingly, it is possible to supply the toner particles t accommodated in the toner bottle 62 of the new replacement unit 60 to the development device 22 of the printer main body B. Next, the handle 83 is turned counterclockwise and the cam 82 is also turned counterclockwise. Then, the introduction pipe 81 is moved upward to insert the insertion pins 85 into the liquid supplying ports 72 and the seat member 74 is penetrated. In synchronization with this attachment operation, the sealing unit of the liquid supplying port 72 of the newly installed fixing liquid bottle 63 is broken by the tip end of the insertion pin 85 provided in the printer main body B. As a result, the toner fixing liquid 52 is supplied from the fixing liquid bottle 63 through the introduction pipe 81 to the fixing liquid storage 50 of the fixing device 40 of the printer main body B.

The periphery of the insertion pin 85 inserted into the liquid supplying port 72 of the fixing liquid bottle 63 is sealed by the O-ring 73 to prevent the leakage of the liquid. When the replacement unit 60 is attached to the printer main body B, the toner fixing liquid 52 accommodated in the fixing liquid bottle 63 of the replacement unit 60 is supplied to the fixing liquid storage 50 of the fixing device 40 at a time so that the fixing liquid bottle 63 becomes empty. In this manner, when it is necessary to replace the fixing liquid bottle 63 in use for some reason, the user or the like can perform the operation without causing the toner fixing liquid 52 to spoil on the hands and clothes of the user or soil the floor and the printer main body B.

Note that, in the above-described example, the four insertion pins 85 are moved at the same time by one handle 83, but they may be separately moved by plural of the handles 83 for each color.

Furthermore, in the above-described example, the respective colors of the replacement units 60 are made the same in size, but the black replacement unit 60BK may be made larger than the other colors of the replacement units 60M, 60Y, and 60C so that accommodation amounts of the toner particles t and the toner fixing liquid 52 of the black replacement unit 60BK are larger than those of the other colors of the replacement units 60M, 60Y, and 60C.

Meanwhile, the fixing liquid storage 50 is of an adequate size to prevent the overflow of the toner fixing liquid 52. Furthermore, as described above, the toner fixing liquid 52 sufficient to fix all the toner particles t is put in the color printer shown in FIG. 1 in a balanced manner. However, if the balance is lost for some reason, it is necessary to perform a proper treatment. That is, when the water-level sensor 54 detects the full status of the toner fixing liquid 52 due to its excess amount, the stopper pin 84 is popped up to prevent the turning of the handle 83 counterclockwise. Accordingly, the replacement of the replacement unit 60 is not allowed. Conversely, when the water-level sensor 55 detects the empty status of the toner fixing liquid 52, the driving of the printer main body B is stopped to prevent the recording member from being discharged outside the printer with unfixed toner particles t put on the recording member. Then, a message prompting the user to replenish the toner fixing liquid 52 is displayed on a monitor, and the operation of the printer is stopped until the replenishment of the toner fixing liquid 52 is completed.

In order to keep the balance between the toner particles t and the toner fixing liquid 52 in the printer, only the fixing liquid bottle 63 accommodating the amount of the toner fixing liquid 52 "1.0" through 1.2 times the amount A of the toner fixing liquid 52 necessary for fixing the toner particles t accommodated in the toner bottle 62 is capable of being connected to the toner bottle 62.

For example, if there are two types of the toner bottles 62 for printing 5,000 papers and 10,000 papers, respectively, having different amounts of the toner particles t, two types of the fixing liquid bottles 63 having corresponding amounts of the toner fixing liquid 52 enough to fix the toner particles t are prepared. At this time, only the toner bottle 62 and the fixing liquid bottle 63 having the corresponding amounts of the toner particles t and the toner fixing liquid 52, respectively, are aligned with each other at a snap fit connection so as to be connected. If the amount of the toner fixing liquid 52 does not balance with that of the toner particles t, the fixing liquid bottle 63 is not capable of being connected to the toner bottle 62.

As described above, when the toner bottle 62 is replaced, the fixing liquid bottle 63 is also replaced in the color printer in FIG. 1. Therefore, the toner particles and the toner fixing liquid 52 are replenished into the printer main body B at the same time. In other words, the user is allowed to efficiently and easily replenish them, making it possible to enhance the efficiency and the simplification of maintenance work.

At the time of disposal, the locking claws 78 relative to the locking holes 77 are unhooked, so that the toner bottle 62 made of a polyester material and the fixing liquid bottle 63 made of polycarbonate that is different from the toner bottle 62 in material can be separated. Therefore, it is possible to facilitate the separate disposal of the replacement unit 60 in consideration of environmental friendliness.

As described above, the replacement unit 60 has the toner bottle 62 and the fixing liquid bottle 63 integrated with each other, and it is collectively provided in the printer main body B in a replaceable manner. However, when the toner fixing liquid 52 leaking from the liquid supplying port 72 of the fixing liquid bottle 63 of the replacement unit 60 reaches the toner supplying port of the toner bottle 62 of the replacement unit 60, unused toner particles around the toner supplying port may be dissolved. Therefore, in the above-described example, the toner supplying port of the toner bottle 62 and the liquid supplying port 72 of the fixing liquid bottle 63 are provided so as to be separated from each other on the opposite sides of the replacement unit 60. As shown in FIG. 3, the toner supplying direction p of toner particles from the toner supplying port and the fixing liquid supplying direction q of the toner fixing liquid 52 from the liquid supplying port 72 are oriented in different directions. With this configuration, any toner fixing liquid 52 leaking from the fixing liquid bottle 63 hardly reaches the toner bottle 62.

If the toner bottle 62 is of a type that supplies accommodated toner particles due to gravity unlike the one that feeds toner particles with its rotation as described above, the toner bottle 62 and the fixing liquid bottle 63 are detachably connected together, for example, by a snap fit connection as shown in FIG. 6.

Figure 6A:
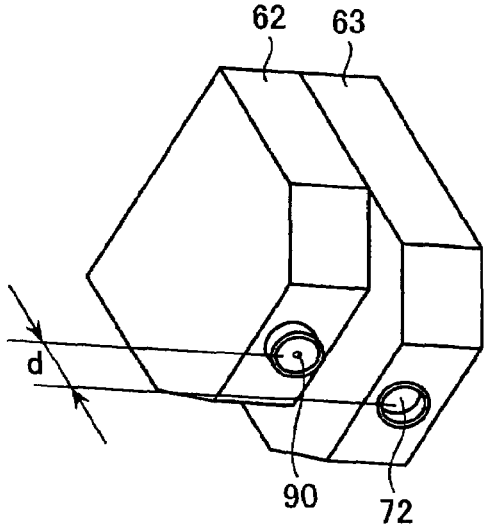
FIGS. 6A through 6C are a perspective view of another example of the replacement unit, a side view of still another example thereof, and a perspective view of yet another example thereof, respectively.

Furthermore, in order to prevent any toner fixing liquid 52 leaking from the liquid supplying port 72 of the fixing liquid bottle 63 reaching a toner supplying port 90 of the toner bottle 62 to dissolve unused toner particles, the gap d is provided between the toner supplying port 90 of the toner bottle 62 and the liquid supplying port 72 of the fixing liquid bottle 63 such that the liquid supplying port 72 is positioned lower than the toner supplying port 90 in the gravity direction when the replacement unit is attached to the printer main body B as shown in FIG. 6A. With this configuration, any toner fixing liquid 52 leaking from the liquid supplying port 72 of the fixing liquid bottle 63 is prevented reaching the toner supplying port 90 of the toner bottle 62 against gravity. As a result, it is possible to prevent the unused toner particles around the toner supplying port 90 being dissolved.

Figure 6B:
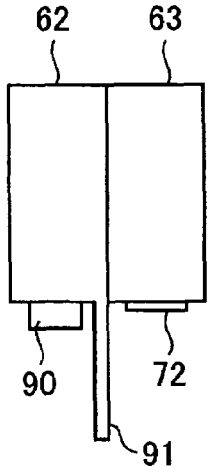

Furthermore, as shown in FIG. 6B, the toner supplying port 90 of the toner bottle 62 and the liquid supplying port 72 of the fixing liquid bottle 63 are partitioned by a partition wall 91. With this configuration, any toner fixing liquid 52 leaking from the liquid supplying port 72 of the fixing liquid bottle 63 is prevented reaching the toner supplying port 90 of the toner bottle 62 partitioned by the partition wall 91. As a result, it is possible to prevent the unused toner particles t around the toner supplying port 90 being dissolved. Note that the partition wall 91 is provided in the toner bottle 62 in this example, but it may be provided in the fixing liquid bottle 63.

Figure 6C:
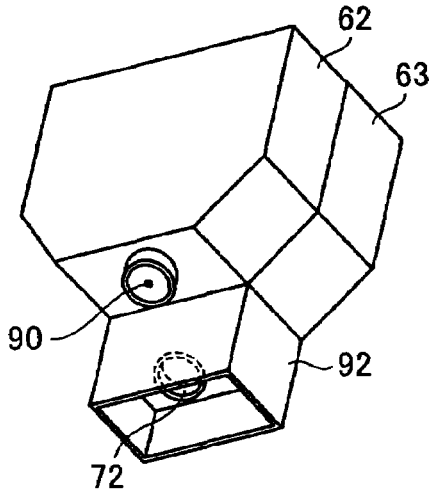

Moreover, as shown in FIG. 6C, the liquid supplying port 72 of the fixing liquid bottle 63 is surrounded by a partition wall 92. With this configuration, any toner fixing liquid 52 leaking from the liquid supplying port 72 of the fixing liquid bottle 63 is prevented flowing out the surrounding partition wall 92 and reaching the toner supplying port 90 of the toner bottle 62. As a result, it is possible to prevent the unused toner particles around the toner supplying port 90 being dissolved.

The present invention is not limited to the specifically disclosed embodiments, but variations and modifications may be made without departing from the scope of the present invention.

The present application is based on Japanese Priority Application No. 2007-188330 filed on Jul. 19, 2007, the entire contents of which are hereby incorporated herein by reference.

What is claimed is:

1. A replacement unit comprising:

a toner bottle; and a fixing liquid bottle; wherein the toner bottle and the fixing liquid bottle are integrated with each other and collectively provided in an image forming apparatus main body in a replaceable manner, the toner bottle accommodates toner particles to be supplied to a development device of the image forming apparatus main body, and the fixing liquid bottle accommodates a toner fixing liquid that includes a softening agent for softening the toner particles and a solvent for dissolving or dispersing the softening agent, the toner fixing liquid being supplied to a fixing device of the image forming apparatus main body so as to be applied to unfixed toner particles on a recording member, the toner fixing liquid dissolving the unfixed toner particles and being fixed on the recording member.

2. The replacement unit according to claim 1, wherein the toner bottle and the fixing liquid bottle are separately formed and integrally connected together in a detachable manner.

3. The replacement unit according to claim 2, wherein the toner bottle and the fixing liquid bottle have different materials.

4. The replacement unit according to claim 2, wherein the toner bottle and the fixing liquid bottle are connected together by a snap fit connection.

5. The replacement unit according to claim 1, wherein, assuming that an amount of the toner fixing liquid necessary for fixing the toner particles accommodated in the toner bottle is A, an amount of the toner fixing liquid 1.0 through 1.2 times the amount A is accommodated in the fixing liquid bottle.

6. The replacement unit according to claim 1, wherein a liquid supplying port of the fixing liquid bottle is sealed by a breakable sealing unit.

7. The replacement unit according to claim 1, wherein a toner supplying direction from a toner supplying port of the toner bottle is different from a fixing liquid supplying direction from a liquid supplying port of the fixing liquid bottle.

8. The replacement unit according to claim 1, wherein a gap is provided between a toner supplying port of the toner bottle and a liquid supplying port of the fixing liquid bottle such that the liquid supplying port is positioned lower than the toner supplying port in a gravity direction when the replacement unit is attached to the printer main body.

9. The replacement unit according to claim 1, wherein a toner supplying port of the toner bottle and a liquid supplying port of the fixing liquid bottle are partitioned by a partition wall.

10. The replacement unit according to claim 1, wherein a liquid supplying port of the fixing liquid bottle is surrounded by a partition wall.

11. An image forming apparatus comprising the replacement unit according to claim 1.

12. The image forming apparatus according to claim 11, wherein, if there are plural of the replacement units having different amounts of the toner particles accommodated in the toner bottles, only the fixing liquid bottle accommodating an amount of the toner fixing liquid 1.0 through 1.2 times an amount A of the toner fixing liquid necessary for fixing the toner particles accommodated in the toner bottle of one replacement unit is capable of being connected to the corresponding toner bottle of the replacement unit.

13. The image forming apparatus according to claim 11, wherein different colors of replacement units accommodating different colors of the toner particles are provided in the image forming apparatus main body in a replaceable manner, and accommodation amounts of the toner particles and the toner fixing liquid of a black replacement unit are made larger than the accommodation amounts of the toner particles and the toner fixing liquid, respectively, of other colors of the replacement units among the plural colors of the replacement units.

14. The image forming apparatus according to claim 11, wherein a member that breaks a sealing unit of the replacement unit in synchronization with an attachment of the replacement unit to the image forming apparatus main body is provided in the image forming apparatus main body.

15. The image forming apparatus according to claim 14, wherein a sheet member that seals a liquid supplying port of the fixing liquid bottle is used as the sealing unit, and a member that penetrates the sheet member in synchronization with the attachment of the replacement unit to the image forming apparatus main body is provided in the image forming apparatus main body.

16. A method of attaching a replacement unit of an image forming apparatus, comprising:

attaching a replacement unit having a toner bottle and a fixing liquid bottle integrated with each other to an image forming apparatus main body;

allowing toner particles accommodated in the toner bottle to be supplied to a development device of the image forming apparatus main body;

breaking a sealing unit of a liquid supplying port of the fixing liquid bottle using a member provided in the image forming apparatus main body in synchronization with the attachment of the replacement unit to the image forming apparatus main body; and supplying a toner fixing liquid made up of a softening agent for softening the toner particles and a solvent for dissolving or dispersing the softening agent from the fixing liquid bottle to a fixing liquid storage of a fixing device of the image forming apparatus main body.

17. The method of attaching a replacement unit of an image forming apparatus according to claim 16, wherein a sheet member that seals the liquid supplying port of the fixing liquid bottle is used as the sealing unit, and the sheet member is penetrated by a member provided in the image forming apparatus main body in synchronization with the attachment of the replacement unit to the image forming apparatus main body so as to supply the toner fixing liquid to the fixing liquid storage.

18. The method of attaching a replacement unit of an image forming apparatus according to claim 16, wherein the toner fixing liquid is supplied to the fixing liquid storage at a time when the replacement unit is attached to the image forming apparatus main body.

* * * * *